US011058264B1

(12) United States Patent
Cohen

(10) Patent No.: US 11,058,264 B1
(45) Date of Patent: Jul. 13, 2021

(54) TOILET PAPER DISPENSER

(71) Applicant: Stephen M. Cohen, Greeneville, TN (US)

(72) Inventor: Stephen M. Cohen, Greeneville, TN (US)

( * ) Notice: Subject to any disclaimer, the term of this patent is extended or adjusted under 35 U.S.C. 154(b) by 96 days.

(21) Appl. No.: 16/663,635

(22) Filed: Oct. 25, 2019

(51) Int. Cl.
*A47K 10/38* (2006.01)
*A47K 10/32* (2006.01)

(52) U.S. Cl.
CPC ..... *A47K 10/38* (2013.01); *A47K 2010/3253* (2013.01)

(58) Field of Classification Search
USPC ..... 242/560, 560.2, 560.3, 561, 594, 594.3, 242/594.5, 594.6
See application file for complete search history.

(56) References Cited

U.S. PATENT DOCUMENTS 3,642,336 A * 2/1972 Harvey, Sr. ..... A47K 10/40 312/34.22
4,003,526 A * 1/1977 Fishburn ..... A47K 10/38 242/560.3
4,998,681 A * 3/1991 McNeill ..... A47K 10/3836 242/560.2
5,624,025 A * 4/1997 Hixon ..... A47K 10/32 206/233
5,690,495 A * 11/1997 Collier ..... A47K 10/38 242/594.3
5,752,622 A * 5/1998 Abell ..... A47K 10/38 221/281
5,878,893 A * 3/1999 Micienko ..... A47K 10/38 211/13.1
7,296,705 B2 * 11/2007 Boulet-Mazer .... A47K 10/3818 221/34
7,407,237 B2 * 8/2008 Bright ..... A47B 67/02 312/242
10,104,965 B1 10/2018 Miller
D886,488 S * 6/2020 Orban ..... D6/520
2007/0095769 A1 * 5/2007 Jenkins ..... A47K 10/38 211/119.009
2007/0181594 A1 * 8/2007 Thompson ..... A47K 10/421 221/190
2012/0256036 A1 * 10/2012 Osborne ..... A47K 10/38 242/560
2019/0290078 A1 * 9/2019 Moses ..... A47K 1/09

* cited by examiner

*Primary Examiner* — William A. Rivera
(74) *Attorney, Agent, or Firm* — Sanchelima & Associates, P.A.; Christian Sanchelima; Alexander Rodriguez

(57) ABSTRACT

A system for a toilet paper holder and dispenser including a dispensing assembly, a storage assembly and a shelf assembly is disclosed. The toilet paper dispenser includes means for dispensing toilet paper to users, preferably in commercial bathrooms. The toilet paper dispenser is capable of also storing additional toilet paper rolls for future usage. The shelf assembly includes a shelf atop of the storage assembly for holding items thereon, such as a mobile phone, for example. The shelf includes a non-skid surface that helps to secure items placed thereon from falling to a ground surface. There is also hooks placed adjacent to the toilet paper dispenser which are capable of holding items such as purses or keys, for example.

12 Claims, 3 Drawing Sheets

TOILET PAPER DISPENSER

BACKGROUND OF THE INVENTION

1. Field of the Invention

The present invention relates to a toilet paper dispenser and, more particularly, to a toilet paper dispenser that has a shelf atop of the toilet paper dispenser for holding of items thereon.

2. Description of the Related Art

Several designs for toilet paper dispensers have been designed in the past. None of them, however, include a toilet paper holder and dispenser having a non-skid surface comprising a shelf on the upper face of the toilet paper holder and dispenser, and multiple holding hooks located on the underside of the toilet holder and dispenser, for holding of items such as purses, for example.

Applicant believes that a related reference corresponds to U.S. Pat. No. 10,104,965 for a toilet paper holder mounted adjustable bathroom shelf. Applicant believes another related reference corresponds to. U.S. Pat. No. 10,123,614 for a concealed shelf for mounting above a toiler paper support. None of these references, however, teach of a shelf with a non-skid surface on the upper face of the toilet paper holder and dispenser. Further, none of the references teach of multiple hooks located on the underside of the toilet holder and dispenser.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a toilet paper holder and dispenser with a shelf with a non-skid surface on an upper face thereof.

It is another object of this invention to provide a toilet paper holder and dispenser with multiple hooks located on the underside of the toilet holder and dispenser for holding of items such as purses or keys, for example.

It is still another object of the present invention to provide a toilet paper holder and dispenser that helps to prevent accidental drops of items such as cell phones that may lead to damage needing costly repairs.

It is another object of the present invention to provide a toilet paper holder and dispenser that helps to improve sanitation by keeping items, preferably personal items, off of dirty and unsanitary bathroom floors.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
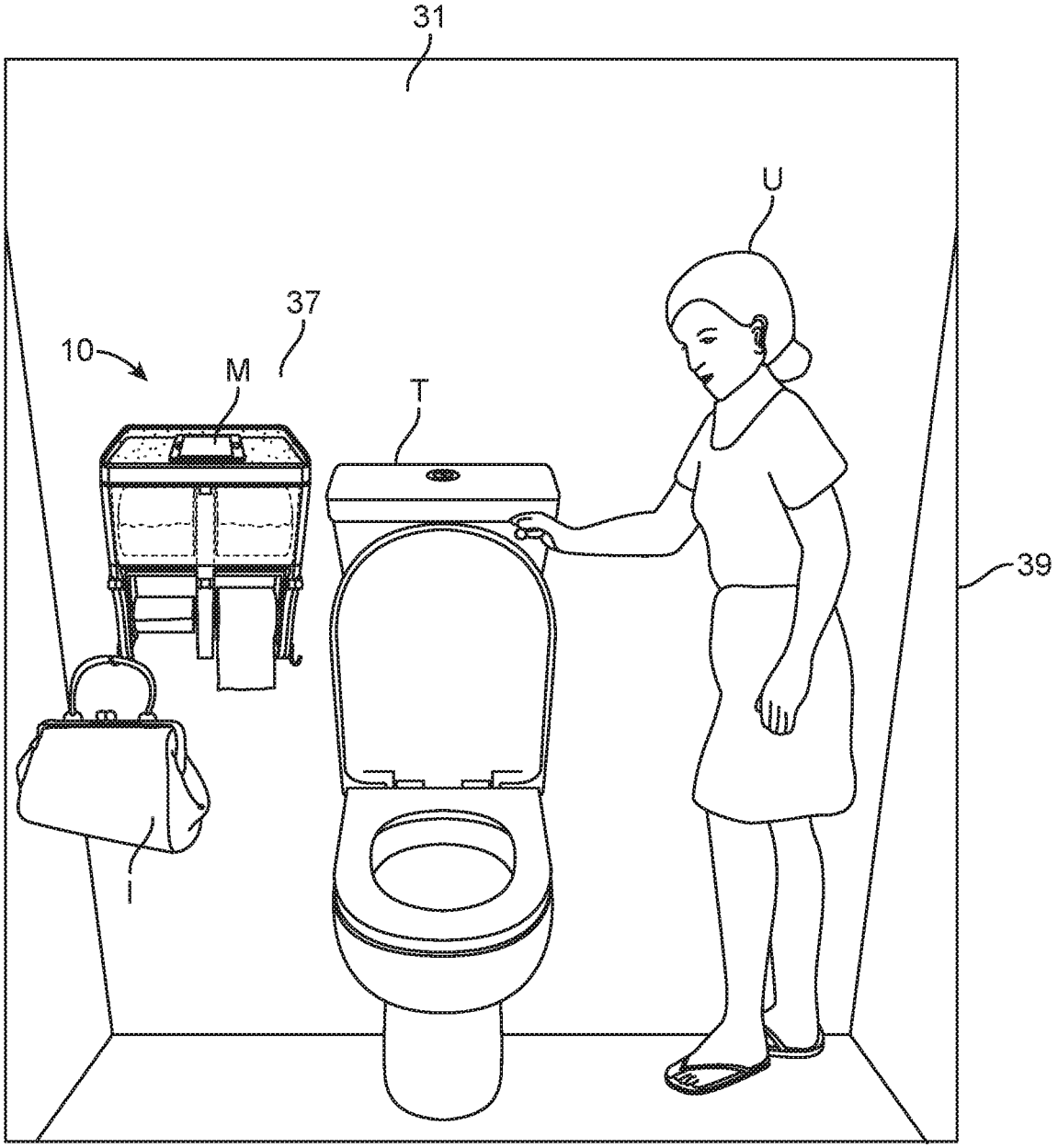
FIG. 1 represents the present invention in an operational setting.

Referring now to the drawings, where the present invention is generally referred to with numeral 10, it can be observed that it, toilet paper holder and dispenser 10, basically includes a dispensing assembly 20, a storage assembly 40 and a shelf assembly 60.

Figure 2:
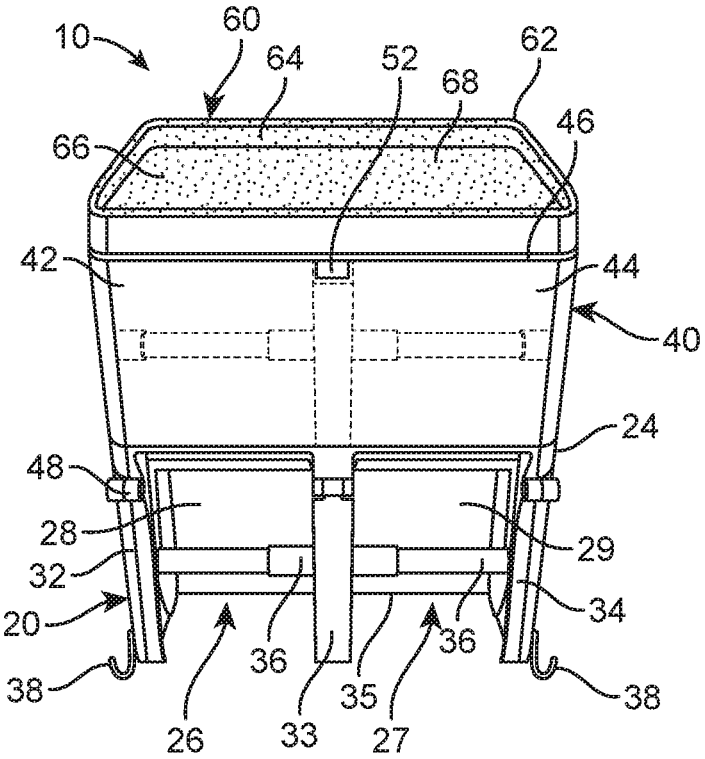
FIG. 2 shows an isometric view of the present invention.
Figure 3:
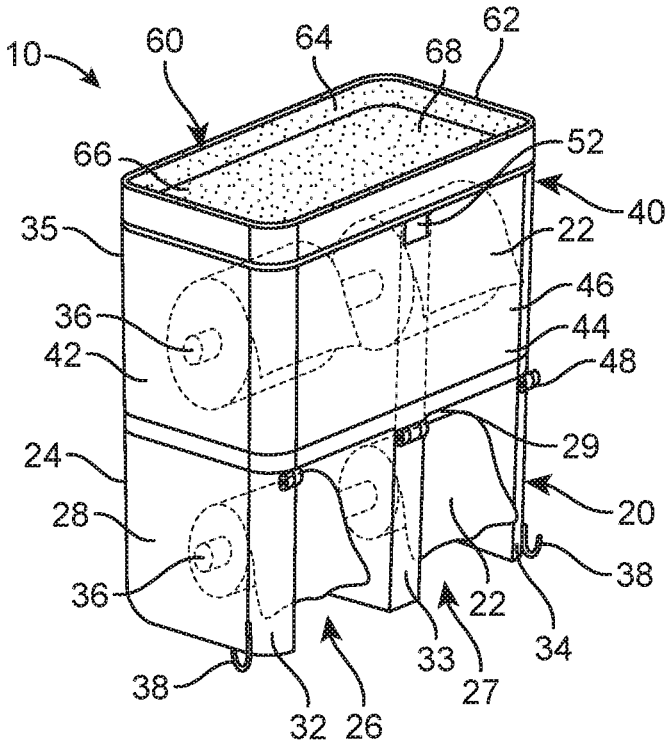
FIG. 3 illustrates an elevated isometric top view of the present invention.

It can be seen that the present invention is shown in FIGS. 1-4. Toilet paper holder 10 importantly includes dispensing assembly 20. Dispensing assembly 20 may be adapted to dispense paper from toilet paper rolls 22. Dispensing assembly 20 may include a dispenser body 24 having a first dispenser 26 and a second dispenser 27. First dispenser 26 includes a first dispensing space 28 for receiving and holding one of toilet paper rolls 22 therein. Second dispenser 27 includes a second dispensing space 29 for receiving and holding another of toilet paper rolls 22 therein. Dispenser body 24 may be defined by a first wall 32, a second wall 33, a third wall 34 and a back wall 35. Each of first wall 32, second wall 33 and third wall 34 may extend vertically and parallel to each other. Back wall 35 may be mounted perpendicularly and adjacently to each of first wall 32, second wall 33 and third wall 34. Back wall 35 may extend vertically as well and may be at a rear side of dispenser body 24. First wall 32, second wall 33, third wall 34 and back wall 35 may extend from dispensing assembly 20 up to storage assembly 40. First dispensing space 28 may be defined as the open space therebetween first wall 32, second wall 33 and back wall 35. First dispensing space 28 may be recessed therein dispenser body 24. Extending horizontally therein first dispensing space 28 may be a toilet paper holder 36 for holding one of toilet paper rolls 22. In one embodiment, toilet paper holder 36 may be a spring-loaded toilet paper holder as known in the other. Second dispensing space 29 may be defined as the open space therebetween second wall 33, third wall 34 and back wall 35. Second dispensing space 29 may be recessed therein dispenser body 24. Extending horizontally therein second dispensing space 29 may be another of toilet paper holder 36 for holding one of toilet paper rolls 22. A user U may dispense paper from toilet paper rolls 22 upon needing to. Dispensing assembly 20 may further include hooks 38. Hooks 38 may be mounted to and underneath dispenser body 24. More specifically, hooks 38 may be mounted underneath first wall 32 and third wall 34 as well. In an alternate embodiment, it may be suitable for hooks 38 to be mounted underneath second wall 33. In an alternate embodiment, hooks 38 may be mounted adjacently to first wall 32 and third wall 34. Hooks 38 may be adapted to secure items thereon, such as keys or purses, for example. Hooks 38 allow user U to avoid placing items on a ground surface of a bathroom 39. Toilet paper holder and dispenser 10 may preferably be mounted therein bathroom 39 that is a commercial bathroom for public usage. More specifically, the present invention may be mounted to therein a stall 31 to a bathroom wall 37 of bathroom 39. It may be preferable that dispenser body 24 be made of plastic. However, it should be understood that dispenser body 24 may be made of other suitable materials such as aluminum, metal, rubber or the like. In one embodiment, dispenser body 24 may preferably be entirely open on a front side and a bottom side thereof.

Toilet paper holder and dispenser 10 may further include storage assembly 40. Storage assembly 40 may be mounted atop of dispensing assembly 20. Storage assembly 40 may include a first holding space 42, a second holding space 44, a cover 46 and hinges 48. Storage assembly 40 may be defined as the space enclosed by cover 46. First holding space 42 and second holding space 44 may be adapted to hold additional of paper rolls 22 for future use. First holding space 42 may be defined as the space therebetween first wall 32, second wall 33 and back wall 35 that is covered by cover 46. Second holding space 44 may be defined as the space therebetween second wall 33, third wall 34 and back wall 35 that is covered by cover 46. Extending therebetween each of first holding space 42 and second holding space 44 may be one of toilet paper holders 36, preferably each holding one of toilet paper rolls 22. Cover 46 may be hingedly mounted to a top portion of dispenser body 24 with hinges 48. In one embodiment, one of hinges 48 may be mounted perpendicularly to each of first wall 32, second wall 33 and third wall 34. With hinges 48 cover 46 may have an open and closed configuration. In the open configuration, cover 46 may be lowered. In the closed configuration, cover 46 may be raised. To maintain cover 46 in the raised and closed configuration a lock 52 may be mounted thereon storage assembly 40. Lock 52 may further be adapted to prevent access to toilet paper rolls 22 being stored to prevent theft or access thereto. Lock 52 may be unlocked by an authorized user once there is a need to retrieve toilet paper rolls 22 stored behind cover 46. Preferably, cover 46 may be transparent or semi transparent in order to determine if there are any of toilet paper rolls 22 being stored therein or if refilling of storage assembly 40 is needed. In one embodiment, cover 46 may be vertical and parallel to back wall 35 in the close configuration. Once there is a need for one of first dispenser 26 or second dispenser 27 to be refilled with a new one of toilet paper rolls 22 then one of toilet paper rolls 22 stored therein first holding space 42 or second holding space 44 may be retrieved and placed therein either one of first dispenser 26 or second dispenser 27 needing refilling.

Mounted atop of dispenser body 22 and above storage assembly 40 may be shelf assembly 60. Importantly, shelf assembly 40 provides a storage area for placing of items such as phones or wallets thereon to avoid needing to place the items on a ground of bathroom 39. Shelf assembly 60 may include a shelf 62. Shelf 62 may be of dimensions and a shape that cooperates with the dimensions and shape of the top end of dispenser body 24. Preferably, shelf 62 may be rectangular. However, it should be understood that shelf 62 may be of any other predetermined shape and dimensions. Shelf 62 may include sidewalls 64 and a shelf floor 66. Sidewalls 64 may extend around a perimeter of shelf 62. Sidewalls may extend a predetermined distance from shelf floor 66. Sidewalls 64 help to secure items placed thereon shelf 62 further. Accidental dropping of items from shelf 62 decreases with the aid of sidewalls 64. Shelf floor 66 may importantly include a non-skid surface 68. Non-skid surface 68 may aid in maintaining items on shelf 62. Non-skid surface 68 may be a high friction surface that reduces movement of items placed thereon shelf floor 66 to reduce accidental dropping of any items held thereon shelf 62. Non-skid surface 68 may entirely cover shelf floor 66.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for a toilet paper dispenser, comprising:

a. a bathroom having a stall with a bathroom wall;

b. a dispensing assembly including a dispenser body and toilet paper rolls, said dispenser body defined by a first wall, a second wall, a third wall and a back wall, said dispenser body having a first dispenser and a second dispenser, said first dispenser having a first dispensing space and said second dispenser having a second dispensing space, said first dispensing space defined by the space therebetween said first wall, said second wall and said back wall, said second dispensing space defined by the space therebetween said second wall, said third wall and said back wall, said first dispensing space and said second dispensing space having each having one of toilet paper holders extending therebetween, each of said toilet paper holders holding and securing one of said toilet paper rolls thereon, said dispensing assembly further including hooks mounted thereto said dispenser body for holding items thereon;

c. a storage assembly at a top end of said dispenser body, said storage assembly defined by said first wall, said second wall, said third wall and said back wall that is enclosed by a cover mounted thereto said dispenser body with hinges, said cover having an open and closed configuration, said cover being raised and vertical in the closed configuration, said cover being lowered in the open configuration, said cover secured in the closed configuration with a lock, said storage assembly further including a first holding space and a second holding space, one of said toilet paper holders extending therebetween said first holding space and holding one of said toilet paper rolls, another of said toilet paper holders extending therebetween said second holding space and holding one of said toilet paper rolls, said first holding space defined as the space therebetween said first wall, said second wall and said back wall enclosed by said cover, said second holding space defined as the space therebetween said second wall, said third wall and said back wall enclosed by said cover;

d. a shelf assembly including a shelf mounted at said top end of said dispenser body above said storage assembly, said shelf including a shelf floor and said sidewalls extending a predetermined height therefrom said shelf floor; and e. said dispenser body mounted to said bathroom wall within said stall and said stall being within said bathroom.

2. The system of claim 1, wherein said shelf floor is entirely covered with a non-skid surface to aid in preventing items held thereon to accidently fall off of said shelf.

3. The system of claim 1, wherein one of said hinges is mounted thereon said first wall, said second wall and said third wall and protruding outwardly therefrom said dispenser body.

4. The system of claim 1, wherein said dispenser body is made of plastic.

5. The system of claim 1, wherein said dispenser body is entirely open on a front side and bottom side thereof.

6. The system of claim 1, wherein said hooks are mounted underneath said first wall and said second wall.

7. The system of claim 1, wherein said hook are mounted adjacent to said first wall and said third wall.

8. The system of claim 1, wherein said toilet paper holders are spring loaded.

9. The system of claim 1, wherein said toilet paper holders are mounted horizontality and perpendicular to said dispenser body.

10. The system of claim 1, wherein said cover is manually operated to move from said open and closed configuration or vice versa for retrieving one of said toilet paper rolls to be placed therein said first dispenser or said second dispenser.

11. The system of claim 1, wherein said cover is manually operated to move from said open and closed configuration or vice versa to place one of said toilet paper rolls therein said first holding space or said second holding space when empty.

12. The system of claim 1, wherein said cover is semi-transparent to allow viewing of first holding space and said second holding space to determine if said first holding space or said second holding space is empty and needs refilling.

* * * * *